United States Patent [19]

Morgan

[11] Patent Number: 4,896,439

[45] Date of Patent: Jan. 30, 1990

[54] SOUND PROOF COVER FOR SOLES OF SPORTSMEN'S SHOES AND METHOD FOR USE

[76] Inventor: Clyde S. Morgan, 305 N. 600 E., Mapleton, Utah 84663

[21] Appl. No.: 242,547

[22] Filed: Sep. 12, 1988

Related U.S. Application Data

[63] Continuation-in-part of Ser. No. 88,713, Aug. 24, 1987, abandoned.

[51] Int. Cl.[4] ..... A43B 5/18; A43B 3/12

[52] U.S. Cl. ..... 36/7.5; 36/11.5; 36/116

[58] Field of Search ..... 36/7.5, 7.1, 7.3, 7.6, 36/7.7, 11.5, 1, 32 R, 30 R, 116

[56] References Cited

U.S. PATENT DOCUMENTS

| | | | |
|---|---|---|---|
| 1,250,852 | 12/1917 | Goldstone | 36/11.5 |
| 2,173,702 | 9/1939 | Winkel | 36/11.5 |
| 2,932,910 | 4/1960 | Brown | 36/7.5 |
| 3,046,172 | 7/1962 | Reid | 36/30 R |
| 4,287,307 | 9/1981 | Hostettler | 36/32 R |

FOREIGN PATENT DOCUMENTS

| | | | |
|---|---|---|---|
| 975471 | 10/1950 | France | 36/11.5 |
| 169273 | 11/1959 | Sweden | 36/11.5 |
| 10731 | of 1906 | United Kingdom | 36/7.5 |
| 1091098 | 11/1967 | United Kingdom | 36/30 R |

*Primary Examiner*—James Kee Chi

[57] ABSTRACT

A sound proof and slip proof cover for soles of sportsmen's shoes comprising a resilient sole having a laminated composition comprising a plurality of layers of foamed material attached together, the bottom layer being made up of a soft foamed material and the top layer being made up of a tougher foamed material, and attaching means to assist in holding the sole to the bottom of the sportsmen's shoes comprising a plurality of straps with loops at the terminal end, and cord means for being passed through the loops and tieing the cord ends together to hold the sole on the sportsmen's shoes.

6 Claims, 2 Drawing Sheets

SOUND PROOF COVER FOR SOLES OF SPORTSMEN'S SHOES AND METHOD FOR USE

This application is a continuation-in-part of application Ser. No. 088,713, filed Aug. 24, 1987, now abandoned.

BACKGROUND OF THE INVENTION

1. Filed of the Invention

This invention relates to a cover for soles of shoes. More particularly, the invention relates to a new type of sound proof cover for soles of sportsmen's shoe, and a method for using the same.

Specifically, the invention provides a new type of cover for soles of sportsmen's shoes which avoids the creation of sound and prevents slipping while stalking game or fishing. The new sound proof cover for the sportsmen's shoe broadly comprises in combination (a) a resilient sole a little larger than the sole of an average sportman's shoe to be covered, which resilient sole has a laminated composition comprising a plurality of layers of foamed material attached together, the bottom layer being made up of a soft foamed material of thickness of at least ½ inch, and the top layer being made up of a tougher foamed material than the bottom layer and having a thickness of at least ¼ inch, (b) attaching means to assist in holding the sole to the bottom of the sportsman's shoe comprising from 6 to 8 short vertical straps attached along the outside edge of the resilient sole with at least three of the straps being attached to the back and back sides of the sole and at least one of the straps being attached at the front end of the sole, the end of the straps not attached to the sole possessing loop means to permit passage of a cord there through, and (c) cord means adapted to being passed through the loops at the end of the straps and being pulled tight to hold the sole on the sportsman's shoe, one end of the cord being passed through the loop of the back three straps and then through all the other loops of the straps and back through the three end straps, the free ends of the cord being capable of being pulled up and around the cord as it passes into the front strap and then pulled tight and the ends tied together to provide a firm hold of the sole onto the sportsman's shoes.

The invention further provides a method for using the above-described new covers which comprises placing the above noted sound proof cover on each of the soles of the sportsman's shoes at the time the stalking of game commences, passing the ends of the cords up and around the cord as it passes into the front strap and then pulling tight so as to firmly bind the sole on the shoe and then tie the ends of the cord with a firm knot. When the hunt is completed, the soles can be removed and placed in storage for the next use.

2. Prior Art

In stalking game there is always the danger of creating a noise which frightens the game and prevents the hunter from getting close enough to kill the game. In many cases, the noise is created by the hunters as they walk along the trail, such as by, for example, stepping on twigs or leaves or by their feet slipping against rocks or branches along the trail. Many attempts have been made to correct this problem as by using shoes with rubber soles, such as tennis shoes, or by wrapping cloth on the bottom of the shoes. These methods, however, have not been too successful as some noise is still created and in many cases, the above-noted methods have interferred with the successful stalking of the game.

It is an object of the invention, therefore, to provide a new type of cover for the soles of sportsmen's shoes which provides a high degree of sound proofing while the hunter is stalking game. It is a further object to provide a new type of cover for the soles of hunter's soles which can be easily and quickly applied and removed. It is a further object to provide a new type of cover for the soles of hunter's shoes which are very light and easily carried to the hunting area. It is a further object to provide a new type of cover for the soles of hunter's feet which can be tightly secured to the soles of the shoes and remain on the soles even under very rugged conditions. It is a further object to provide new slip preventing shoes for fisherman and hunters.

These and other objects will be apparent from the following detailed description thereof.

SUMMARY OF THE INVENTION

It has now been discovered that these and other objects can be accomplished by the new covers for sportsmen's shoes of the present invention which provides for the first time an efficient sound proof and slip resistant cover for said soles.

The new cover for the soles of sportmen's shoes comprise in combination (a) a resilient sole a little larger than the sole of an average sportman's shoe to be covered, which resilient sole has a laminated composition comprising a plurality of layers of foamed material attached together, the bottom layer being made up of a soft foamed material of thickness of at least ½ inch, and the top layer being made up of a tougher foamed material than the bottom layer and having a thickness of at least ¼ inch, (b) attaching means to assist in holding the sole to the bottom of the sportsman's shoe comprising from 6 to 8 short vertical straps attached along the outside edge of the resilient sole with at least three of the straps being attached to the back and back sides of the sole and at least one of the straps being attached at the front end of the sole, the end of the straps not attached to the sole possessing loop means to permit passage of a cord there through, and (c) cord means adapted to being passed through the loops at the end of the straps and being pulled tight to hold the sole on the sportsman's shoe, one end of the cord being passed through the loops of the back three straps and then through all the other loops of the straps and back through the three end straps, the free ends of the cord being capable of being pulled up and around the cord as it passes into the front strap and then pulled tight and the ends tied together to provide a firm hold of the sole onto the sportsman's shoes.

The above-described new type of cover for the soles of sportsman's shoes are preferably utilized in the following manner. The new type of sole covers are carried with the hunter to the stalking area and then placed on the bottom of the hunter's shoes. To tighten the soles on the shoes the free ends of the cord are passed up and around the cord going through the front strap and then pulled back tight and tied to firmly hold the sole on the shoe. The hunter then is capable of walking quietly through the hunting area, and when completed, the soles are removed and placed in storage for the next hunt.

The new covers for the soles of the sportsmen's shoes gives surprising and superior results as compared to prior known techniques for such purposes. The new covers, for example, give a much higher degree of sound proofing than possible heretofore, and thus give the hunter an increased advantage during the hunter. The foam, for example, seems to quickly cover any sound than might be developed while walking in the hunter's trail and the hunter is able to approach the game without making the customary noises which frighten the game. The soles are also unexpectedly rugged and can be worn over very tough terrain without danger of being torn or severely worn. Further advantage is found in the fact that the covers are very light and easy to carry and easy to apply to the shoe sole. In addition, the shoe covers are very compact and can be stored in very small places until needed. The new soles are also ideal for use by by fishermen as they prevent slipping on wet surfaces.

DESCRIPTION OF THE DRAWING

The various objects and features of the present invention will be more fully understood by reference to the accompanying drawings.

DETAILED DESCRIPTION OF THE DRAWINGS

Figure 1:
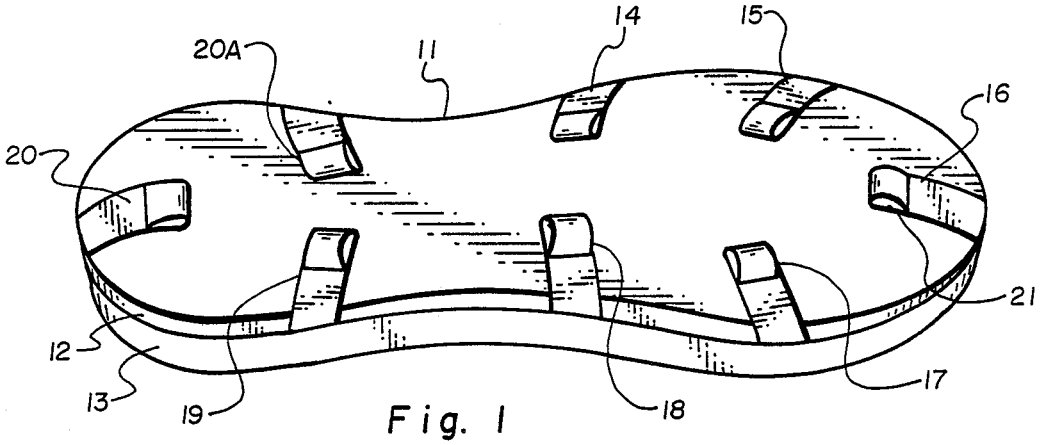
FIG. 1 is a top view of the sound proof and slip proof cover for soles showing the laminate sole and side straps, but without the tie cord.

With reference to FIG. 1 which is a top view of the sound proof cover for soles, the sole is shown as 11, the bottom layer of foam as 13, the top layer of the foam as 12, with the eight straps attached to the sides and being joined under the top foam layer comprising 20, 20A, 14, 15, 16, 17, 18 and 19. The loop at the top of each of the straps is illustrated as item 21.

Figure 2:
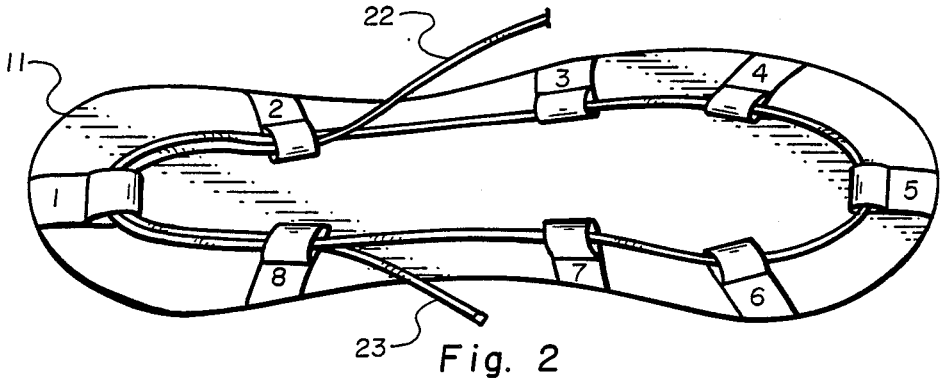
FIG. 2 is a top view of the cover for soles illustrating the method of introducing the cord into the side straps.

With reference to FIG. 2 which is also a top view of the sole cover, the sole is shown as 11 and the eight side straps are identified by numbers 1 through 8. The Figure illustrates how the cord (front end 23 and terminal end 22) is placed within the loops on the straps. The front end 23 is first placed with the loops on straps 2, 1, 8, 7, 6, 5, 4, 3 and then a second time through loops on straps 2, 1 and 8, and then the free end is used with the terminal end to tie the sole on the shoe as shown in in FIG. 3.

Figure 3:
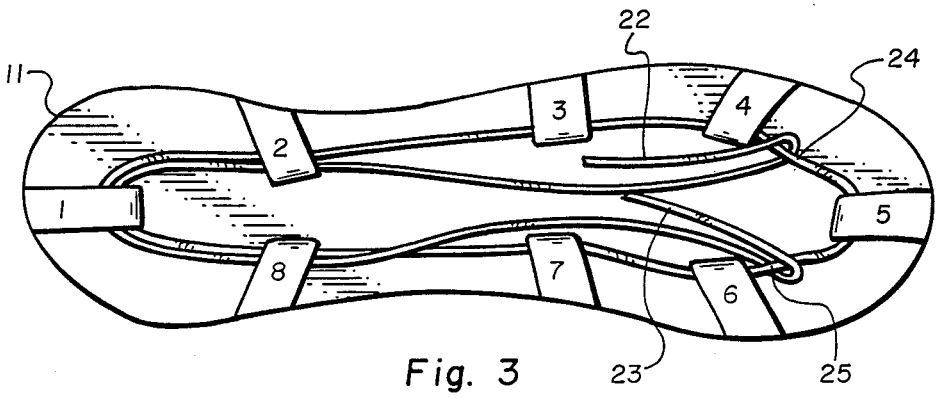
FIG. 3 is a another top view of the cover for the soles showing how the cord may be inserted up and around the front section of the cord and pulled tightly together.

FIG. 3 illustrates how the cord is placed within the loops of the straps and then placed up and around the cord around the front strap 5. In detail, the cord ends 22 and 23 are pulled toward the front of the sole and placed up and around the cord passing through strap 5 and then pulled tight and tied together. Items 23 and 25 illustrate how the cord is placed under and around the front cord of strap 5.

Figure 4:
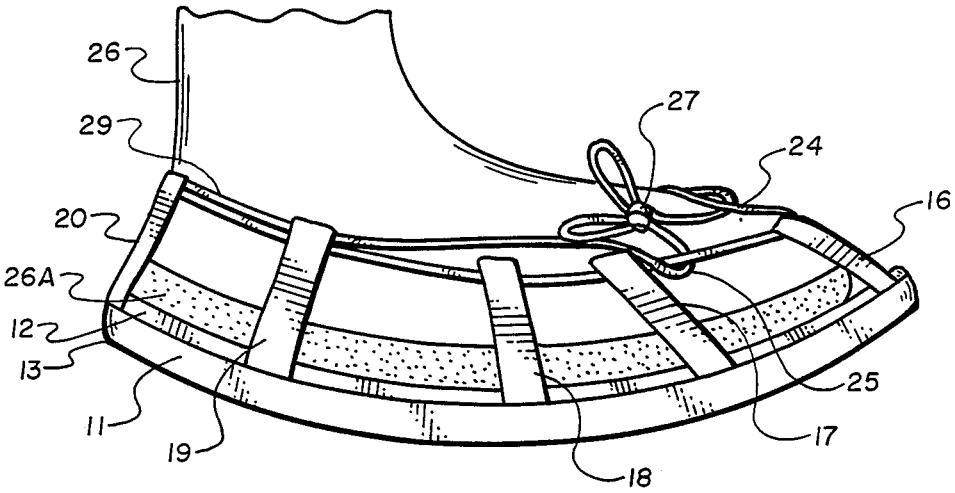
FIG. 4 is a side view showing how the sole may be placed on the shoe of the sportsman and the cord pulled tight and tied together.

With reference to FIG. 4 which is a side view of the shoe placed with the sole cover, the shoe is shown as 26 with shoe sole 26A, the shoe cover as 11, with the laminated sole layers as 12 and 3 and the straps visible from that side as 20, 19, 18, 17 and 16. The cord being pulled tight as 29, and pulled up and around the other cord at location 24 and then tied with the similar cord end on the other side to form bow 27.

Figure 5:
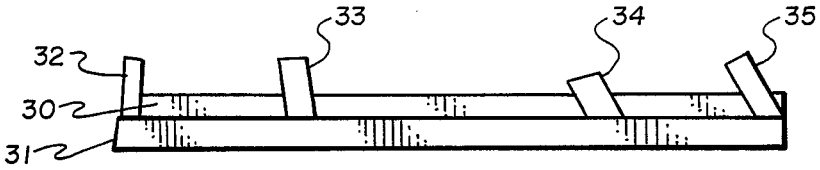
FIG. 5 is a front view of the sole showing the laminated structure and location of the side straps.

FIG. 5 is a front view of the assembled sole cover with out the cord, showing the two layers of foamed material 30 and 31, and the straps 32, 33, 34 and 35.

Figure 6:
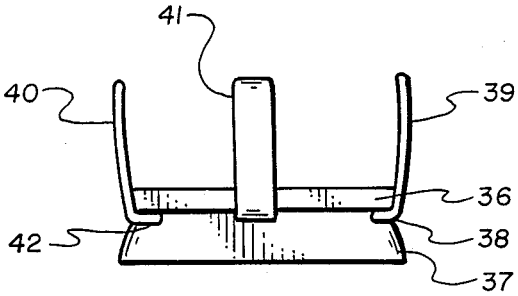
FIG. 6 is an end view of the sound proof cover showing how the side straps may be joined or attached under the top layer of the foamed material.

FIG. 6 is an end view of the sole cover illustrating how the straps may be joined under the bottom of the top layer. The top layer of foam is shown as 36, the side straps as 39, 40 and 41 and the ends of the straps joined under the top layer of foams as 38 and 42. The bottom layer of the foam is shown as 37.

DETAILED DESCRIPTION OF THE INVENTION

As noted above, the resilient sole portion of the cover is a laminated composition comprising a plurality of layers of foamed material joined together, the bottom layer being made up of a soft foamed material of thickness of at least $\frac{1}{2}$ inch and the top layer being made up of a tougher foamed material than the bottom layer and having a thickness of at least $\frac{1}{4}$ inch. The bottom layer of the sole must be of a soft material so as to effect the desired sound proofing quality of the cover. In general, the bottom layer has a density of about 1.5 lbs/ft$^3$ or less, and preferably between 1.5+0.1 and 1.25+0.1 lbs/ft$^3$. Such material also preferably has a tensile strength of about 10 to 13 psi and tear strength of about 1.00 to 1.7 lbs/lin. and compressive strength (ASTMD695) of 40 to 200, with elongation of about 100 to 125%. The material also preferably has at least 50% open cells.

The top layer of the laminated sole is of a tougher foamed material so as to provide a firm basis for the shoe or boot of the sportsmen. Such material preferably has a density greater than 1.5 lbs/ft$^3$, and still more preferably between 1.5 and 1.9 lbs/ft$^3$. Such material also preferably has a tensile strength of about 10 to 13 psi, tear strength of about 1.50 to 1.00 lbs/lin, and enlongation of about 150 to 125%. This material also preferably has at least 50% open cells.

The intermediate layers of foamed material if any are present may be of any type and composition as needed or desired, but in general has a toughness between that of the bottom and top layers. Examples of such include intermediate layers of foamed material having a density between 1.5 and 1.9 lbs/ft$^3$.

As noted other desirable properties for the foamed materials include the compressive strength (ASTMD695) of 40 to 200, and hardness (ASTM D1484) of 60 to 90.

The synthetic foamed material used in the above-noted layers for the resilient sole can be of any suitable thermoplastic or thermosetting foamed product. Examples of these include the polyurethanes, polystyrenes, ABS polymers, nylons, polycarbonates, polyethylene, polypropylene, poly(phenyl oxide), and the like, and mixtures thereof. Preferred foams to be used in the laminated product include the polyurethanes, polyolefins, epoxy resins, polycarbonates, and nylon foams.

The laminated sheets of foam may be joined together by any suitable means, such as by adhesives, heat sealing, tapes, and the like. In general, it is preferred to join the layers together by means of an adhesive, such as epoxy resin adhesives.

As noted the bottom layer of the laminated sole should be at least ½ inches thick, and preferably between ½ and 1 inches. The top layer should be at least ¼ inches in thickness and preferably between ¼ and ½ inches thick. The intermediate layers can vary as desired, but in most cases can vary from about ¼ to ¾ inches in thickness.

The shape of the resilient sole should be of any suitable size but best results are obtained when the sole is at least slightly larger than the sole of the sportsman's shoe, and in most cases from about ⅛ to ¾ inches larger.

As noted above, special attachment means are employed to hold the resilient sole on the sportman's shoe. The attachment means comprise from 6 to 8 short vertical straps attached along the outside edge of the resilient sole with at least three of the straps being attached to the back and back sides of the sole and at least one of the straps being attached at the front end of the sole, the end of the straps not attached to the sole possessing loop means to permit passage of a cord there trhough, and cord means adapted to being passed through the loops at the end of the straps and being pulled tight to hold the sole on the sportsman's shoe, one end of the cord being passed through the loops of the back three straps and then through all the other loops of the straps and back through the three end straps, the free ends of the cord being capable of being pulled up and around the cord as it passes into the front strap end and then pulled tight and the ends tied together to provide a firm hold of the sole onto the shoe.

The above-noted straps can be prepared from any suitable strong material, but are preferably prepared from nylon canvas material, although leather or other materials can be used. The straps are preferably from about ½ to 1¼ inches in width and extend above the top sole from about 1½ to 2½ inches.

The straps can be attached to the sole in any suitable manner. Preferably the bottom end of the straps are attached by gluing or other means to the bottom of the top layer in the resilient sole and then bent up the outside edge of the top layer so as to extend above the said layer.

The terminal end of the straps are bent over and glue to itself so as to form a loop where the cord material can be passed through as noted herein above. The loop is preferably of sufficient width to permit at least two rounds of the cord to pass through, and in most cases is a loop of about ⅜ to ½ inches in width.

The cord which is to be passed through the above-noted loops and the ends tied together to hold the cover on the shoe may be of any suitable strong material that can withstand the tension to be placed thereon in tying the ends together. Preferably the material is conventional nylon cord of ⅛ to ⅜ in diameter.

The new covers of the present invention can be used for a variety of purposes where a high egree of sound proofing is required. As noted above, they are particularly suited for use by hunters as they are stalking game. In this application, the covers are preferably carried to the hunting area by the hunter and then at the time stalking is tarted, they may be placed on the shoes of the hunter and the cord tied to hold the soles tightly on the feet of the hunter. When the hunt is completed, the soles can be removed and placed in storage for the next use.

PREFERRED EMBODIMENT

A preferred embodiment of the invention is described below. It should be understood, however, that this is given as a preferred assembly of the cover intended for specific purposes and is not to be regarded as limiting the invention in any way.

A shoe sole cover was prepared as follows: A bottom sole layer of size 10 shoe was cut out of a sheet of foamed polyurethane having a thickness of ¾ inches and a density of about 1.45 lbs/ft$^3$, tensile strength of 10 psi and an elongation of 100%. A top layer of the sole of the same size was cut out of a sheet of polyurethane having a thickness of about ½ inch and a density of about 1.8 lbs/ft$^3$, and elongation of 150%, with at least 50% open cells.

Eight straps were prepared from nylon canvas strapping material having a width of 1 inch and thickness of about ⅛ inches. One end of each of the straps was bend over and glue back on itself so as to form an open loop of about ½ inch for introduction of the cord as noted hereinafter. The straps were then glued on the bottom of the top layer (½ inch thick layer so as to have the straps extending about the said layer by about 1¾ inches. That layer was then glued to the top of the other foamed layer (¾ inches thick layer). The location of the eight straps are as shown in the attached drawings.

Nylo cord of about ⅛ inches in diameter was then threaded through the loops as shown in FIG. 3.

The cover prepared as above was then placed on the sole of a hunter's shoe, and the resulting combination was then used by a hunter in stalking deer. Surprisingly, it was found that the new covers made the walking almost sound proof and the hunter was able to approach a deer without any sounds being created by his approach.

Another type of sole was prepared as above with the exception that a laminated sole was prepared by forming a sole from a ¾ inch sheet of the foamed material, sewing a ⅛ inch vinyl sheet to the top of the sole and then sewing another ¼ inch sheet of foamed material over the vinyl sheeting. The straps were then placed on the bottom foamed sheet as noted above. This new sole had the advantage of better strength and preventing curling of the foam after a period of use.

I claim as my invention:

1. A sound proof and slip proof cover for soles of sportsmen's shoes comprising in combination (a) a resilient sole a little larger than the sole of the sportsmen's shoe to be covered, which resilient sole has a laminated composition comprising a plurality of layers of foamed material attached together, the bottom layer being made up of a soft foamed material of thickness of at least ½ inch, and the top layer being made up of a tougher foamed material than the bottom layer and having a thickness of at least ¼ inch, (b) attaching means to assist in holding the sole to the bottom of the sportmen's shoe comprising at least 4 short vertical straps attached along the outside edge of the resilient sole with at least three of the straps being attached to the back and back sides of the sole and at least one of the straps being attached at the front end of the sole, the end of the straps not attached to the sole possessing loops to permit passage of a cord there through, and (c) cord adapted to being passed through the loops at the end of the straps and being pulled tight to hold the sole on the sportsmen's shoes.

2. A sound proof and slip proof cover as in claim 1 wherein the number of straps vary from 6 to 8.

3. A sound proof and slip proof cover as in claim 1 wherein wherein one end of the cord that has been passed through all of the loops is passed again through the loop of the back three straps, the free ends of the cord being capable of being pulled up and around the cord as it has passed into the front strap and then pulled tight and the ends tied together.

4. A sound proof and slip proof cover as in claim 1 wherein the foam material is polyurethane.

5. A sound proof and slip proof cover as in claim 1 wherein the foamed material has from 50% to 100% open cells and elongation between 100% and 150%.

6. A sound proof and slip proof cover as in claim 1 wherein the top layer of foamed material has a density greater than 1.5 $lbs/ft^3$, and the bottom layer has a density less than 1.5 $lbs/ft^3$.

* * * * *